US005444452A

United States Patent [19]

Itoh et al.

[11] Patent Number: 5,444,452

[45] Date of Patent: * Aug. 22, 1995

[54] DUAL FREQUENCY ANTENNA

[75] Inventors: Munehiko Itoh, Osaka, Japan; Masao Arakawa, Cupertino, Calif.; Raj Mittra, Champaign, Ill.

[73] Assignee: Matsushita Electric Works, Ltd., Osaka, Japan

[ * ] Notice: The portion of the term of this patent subsequent to Jun. 21, 2011 has been disclaimed.

[21] Appl. No.: 191,937

[22] Filed: Feb. 4, 1994

Related U.S. Application Data

[63] Continuation-in-part of Ser. No. 912,532, Jul. 13, 1992, Pat. No. 5,323,168.

[51] Int. Cl.[6] ..... H01Q 1/38

[52] U.S. Cl. ..... 343/700 MS; 343/769; 343/830

[58] Field of Search ..... 343/700 MS, 769, 846, 343/789

[56] References Cited

U.S. PATENT DOCUMENTS

| | | | |
|---|---|---|---|
| 2,287,220 | 6/1942 | Alford | 250/33 |
| 2,362,561 | 11/1944 | Katzin | 250/11 |
| 2,398,096 | 4/1946 | Katzin | 250/11 |
| 2,479,227 | 8/1949 | Gilbert | 250/33 |
| 3,541,557 | 11/1970 | Hiley | 343/746 |
| 3,665,480 | 5/1972 | Fassett | 343/754 |
| 3,713,167 | 1/1973 | David | 343/789 X |
| 3,739,386 | 6/1973 | Jones, Jr. | 343/708 |
| 3,803,623 | 4/1974 | Charlot, Jr. | 343/846 |
| 3,971,032 | 7/1976 | Munson et al. | 343/770 |
| 4,060,810 | 11/1977 | Kerr et al. | 343/700 |
| 4,089,003 | 5/1978 | Conroy | 343/700 |
| 4,131,892 | 12/1978 | Munson et al. | 343/700 |
| 4,131,893 | 12/1978 | Munson et al. | 343/700 |
| 4,197,544 | 4/1980 | Kaloi | 343/846 X |
| 4,218,682 | 8/1980 | Yu | 343/700 |
| 4,313,121 | 1/1982 | Campbell et al. | 343/790 |
| 4,320,402 | 3/1982 | Bowen | 343/700 |
| 4,821,040 | 4/1989 | Johnson et al. | 343/700 |
| 4,897,421 | 1/1991 | Sunahara et al. | 343/700 |
| 5,099,249 | 3/1992 | Seavey | 343/700 MS |

OTHER PUBLICATIONS

Bahl, I. J. & Bhartia, P., "Microstrip Antennas," Artech House, 1984, pp. 1–29 et seq.

Deschamps, G. A., "Microstrip Antennas," Third U.S-.A.F. Symposium on Antennas, 1953. (not available).

Howell, John Q., "Mircostrip Antennas", I.E.E.E. Transactions on Antennas and Propogation, 1975, pp. 90–93.

Munson, Robert E., "Microstrip Antennas," Antenna Engineering Handbook, 1984, pp. 7–1 to 7–28.

*Primary Examiner*—Donald Hajec
*Assistant Examiner*—Tho Phan
*Attorney, Agent, or Firm*—Hickman & Beyer

[57] ABSTRACT

An antenna apparatus for receiving two distinct frequencies in the MHz or GHz range. A patch layer of electrically conducting material is positioned in the interior of a dielectric layer that has top and bottom surfaces. First and second ground planes are positioned on the top and bottom surfaces of the substrate, respectively. The patch is electrically connected by plated via holes to an annular strip of conducting material, positioned on the top substrate surface and surrounding the first ground plane. A patch antenna for receiving a first frequency is thus formed by the patch layer and the second ground plane. A cavity antenna for receiving a second frequency is formed from the patch layer, the first ground plane, and the annular strip. Two receiver feed connections, positioned at selected first and second positions on the patch resonator, receive distinct first and second frequencies.

32 Claims, 7 Drawing Sheets

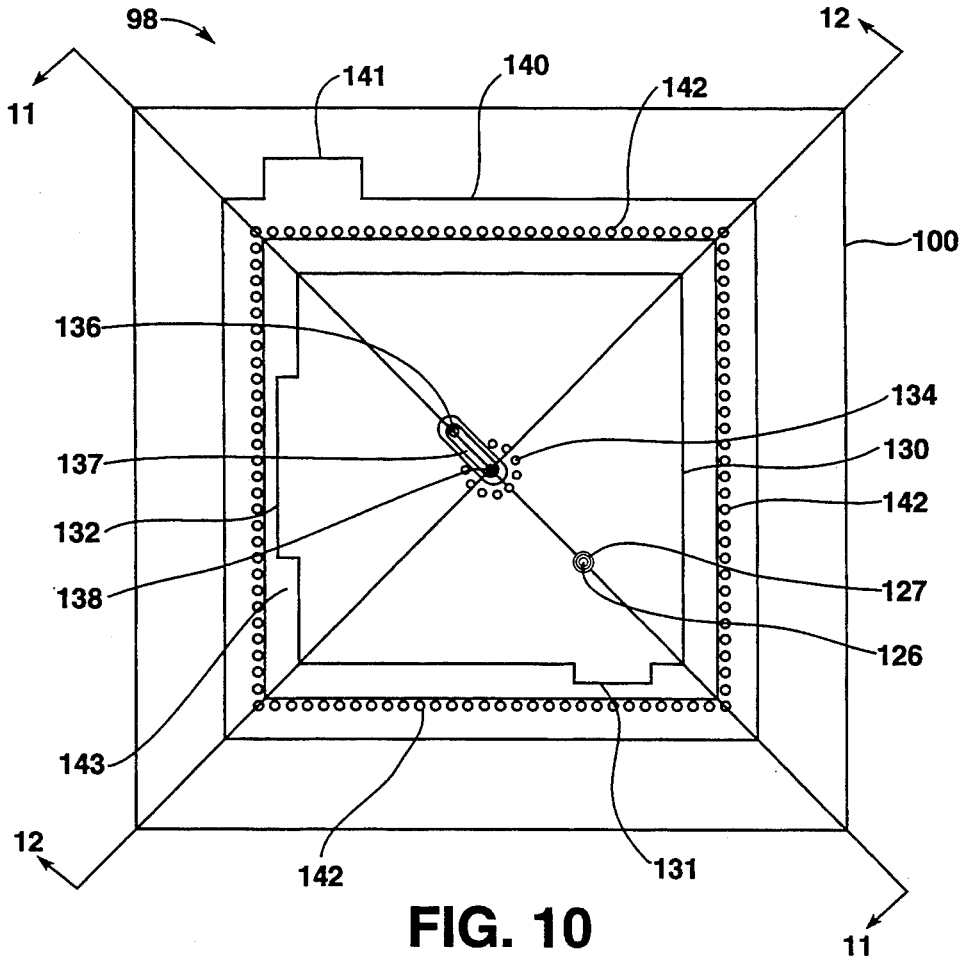
FIG. 10
FIG. 11
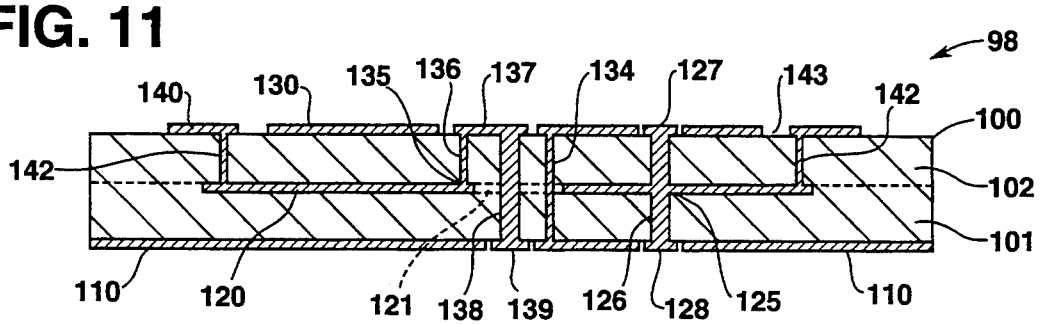
FIG. 12
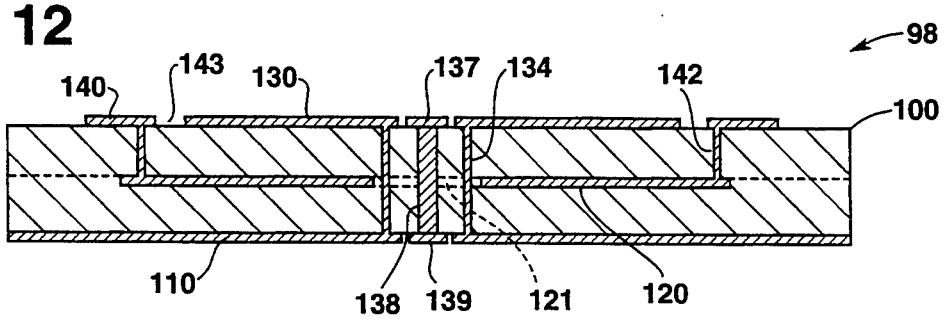

DUAL FREQUENCY ANTENNA

CROSS REFERENCE TO RELATED APPLICATIONS

This application is a continuation-in-pan of co-pending parent patent application 07/912,532, filed Jul. 13, 1992, now U.S. Pat. No. 5,323,168, on behalf of Itoh et al., entitled, "Dual Frequency Antenna", which is hereby incorporated by reference herein.

BACKGROUND OF THE INVENTION

This invention relates to dual frequency antennas for reception and/or transmission of electromagnetic signals.

Many telecommunication systems in use today require use of multiple frequencies for proper operation. For example, the Global Positioning System (GPS) implemented by the U.S. Government requires use of two frequencies, 1.227 GHz and 1.575 GHz, in order to compensate for some of the effects of frequency-dependent ionospheric delay on propagation of electromagnetic signals through the ionosphere. For similar reasons, the GLONOSS global positioning and navigation system of the former Soviet Union uses two frequencies, 1.246 GHz and 1.602 GHz. One design of a wireless Local Area Network (LAN) uses three frequency ranges, 0.902–0.928 GHz, 2.400–2.485 GHz and 5.725–5.850 GHz, for control and data transmission purposes. Use of multiple frequencies may require use of multiple antennas, which may create space allocation problems in a transmitter or receiver with a size constraint imposed.

Microstrip antennas, which were first discussed by G. A. Deschamps in "Microstrip Microwave Antennas", Third U.S.A.F. Symposium on Antennas", 1953, offer a possible solution to the size problem for multiple antennas. These antennas have been discussed in more detail by J.Q.Howells in "Microstrip Antennas", I.E.E.E. Trans. on Antennas and Propagation, 1975, pp. 90–93; by R.E.Munson in "Microstrip Antennas", in Antenna Handbook, edited by Skolia, pp. 7-1 to 7-28; and by I. J. Bahl and P. Bhartia, Microstrip Antennas, Artech House, 1984, pp. 1–29 et seq.

A microstrip (ms) antenna, in its simplest form, consists of a thin electromagnetic resonator layer of carefully chosen dimensions, a ground plane, a dielectric layer contiguous to and separating the resonator and the ground plane, and an antenna signal feed connected to the resonator at a carefully chosen position. Microstrip antennas are available as patch antennas, as traveling wave antennas and as slot antennas, depending upon the geometry chosen for the resonator. These types of ms antennas are discussed and contrasted by Bahl and Bhartia, op. cit. A ms antenna offers several advantages relative to conventional antennas: (1) the ms antenna size is quite small, having typical dimensions of the order of 10 cm×10 cmx 1 cm; (2) fabrication cost of a ms antenna is low for high volume production; (3) a ms antenna has low scattering cross-section; (4) linear, as well as circular (right hand or left hand) polarization for the radiating waves is available; (5) fed lines are fabricated simultaneously with fabrication of the remainder of the ms antenna; and (6) the choice of operating frequency may be chosen over a broad range from 100 MHz to 50 GHz. However, the ms antenna also has certain disadvantages: (1) the bandwidth for ms antenna operation is usually small, with a typical full width at half maximum (FWHM) of about 10 MHz; (2) an ms antenna has some loss so that gain is limited, usually to 20 dB or less; (3) except for special designs, an ms antenna usually radiates into a half plane and has poor endfire performance; (4) isolation between the feed line and the radiating element is a serious problem; (5) an ms antenna may excite surface waves as well; and (6) an ms antenna has relatively low power handling capability.

Dual frequency ms antennas have been discussed by Munson, op. cit., and by Bahl and Bhartia, op. cit., pp. 69–75, 127–132 and 157–162, and elsewhere in the literature within the last ten years. These dual frequency configurations usually employ a stacked ground plane and first and second patch resonators, spaced apart by two dielectric layers, with the first and second resonators each radiating at distinct resonant frequencies. Each patch resonator requires a separate feed line, and the two frequencies must differ from each other by at least 10–20 percent. The material for, and thickness of, the dielectric layer separating the first and second resonators must be carefully controlled to provide reasonable electromagnetic isolation of the resonators and their associated frequencies.

What is needed is a more compact dual frequency ms antenna that does not require fabrication of two electrically separated resonator regions and for which the dielectric materials and thicknesses used are not so critical in fabrication of the antenna. Preferably, the dual frequency antenna should allow use of a wide range of dielectric materials and should offer improved spatial directivity and FWHM bandwidth for the radiation fields.

SUMMARY OF THE INVENTION

These needs are met by the apparatus provided by the invention, which uses a single electromagnetically radiating surface to receive or transmit two distinct microwave frequencies. The apparatus includes a substrate of dielectric material of selected thickness having top and bottom (first and second) opposed surfaces. A first ground plane and second ground plane are provided on the top and bottom surfaces of the substrate, respectively, and a patch layer of electrically conducting material is positioned in the interior of the substrate material, at selected distances from the first and second substrate surfaces. An annular strip made of electrically conducting material and of selected dimensions is positioned on the top substrate surface, spaced apart from and surrounding the first ground plane. The annular strip and patch layer are electrically connected, and two signal feed lines are connected to the patch layer. A patch antenna for receiving a first frequency is thus formed by the patch layer and the second ground plane, and a cavity antenna for receiving a second frequency is formed from the patch layer, the first ground plane, the annular strip, and the electrical connections between the patch layer and annular strip.

The patch layer, the first ground plane, and the annular strip may be formed as squares, rectangles, polygons, circles or ovals, with different frequency response characteristics. In one embodiment of the apparatus, the FWHM bandwidth of the antenna is more than 20 MHz and the receiver sensitivity falls by less than 10 dB over an azimuthal angle range of $-90°$ to $+90°$.

The dual frequency antenna of the present invention provides accurate reception of two different frequencies with no substantial mutual coupling between the included patch antenna and cavity antenna. Exact and consistent frequency matching for both of these antennas is thus promoted. Feedpoints and layers of the dual frequency antenna are also positioned to allow easy, low-cost manufacture.

These and other advantages of the present invention will become apparent to those skilled in the art upon a reading of the following specification of the invention and a study of the several figures of the drawing.

BRIEF DESCRIPTION OF THE DRAWINGS

FIG. 10 is a plan view of a dual frequency antenna apparatus in accordance with a second preferred embodiment of the present invention;

FIG. 11 is a sectional view taken along line 11—11 of FIG. 1;

FIG. 12 is a sectional view taken along line 12—12 of FIG. 1;

DETAILED DESCRIPTION OF THE PREFERRED EMBODIMENTS

Figure 1:
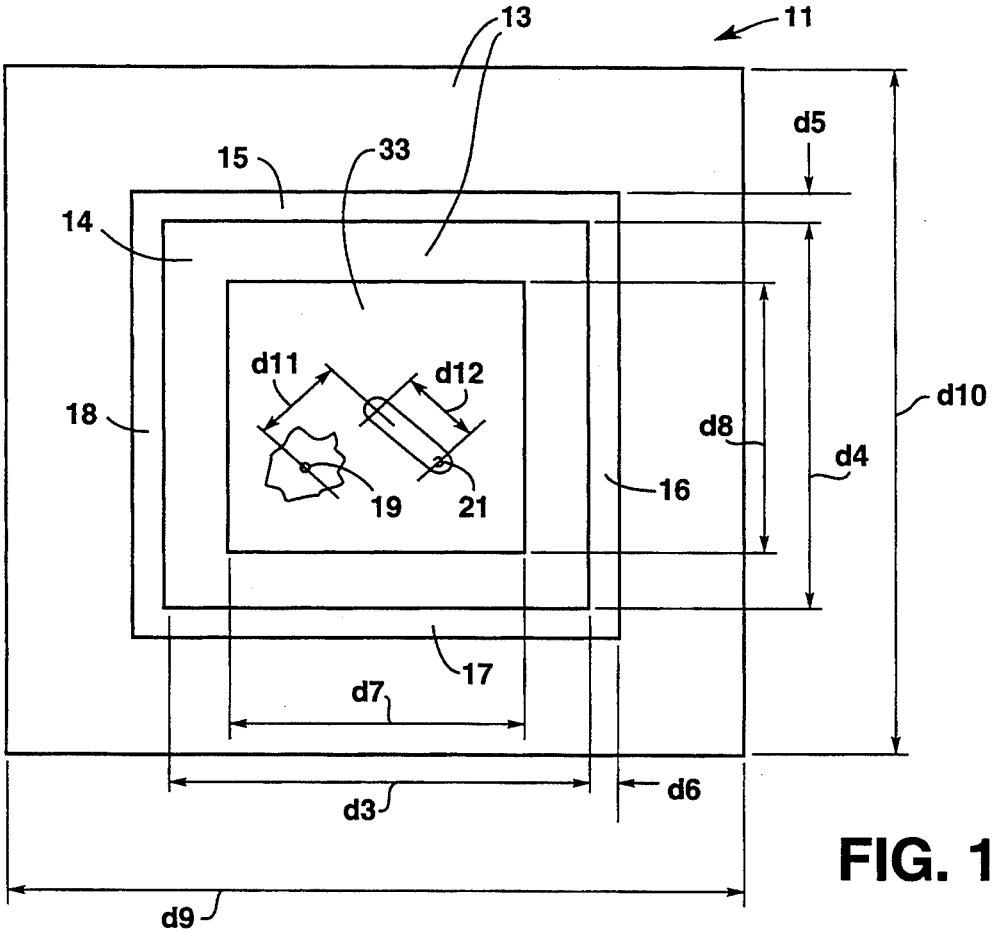
FIG. 1 is a top plan view of a dual frequency antenna apparatus of the present invention.
Figure 2:
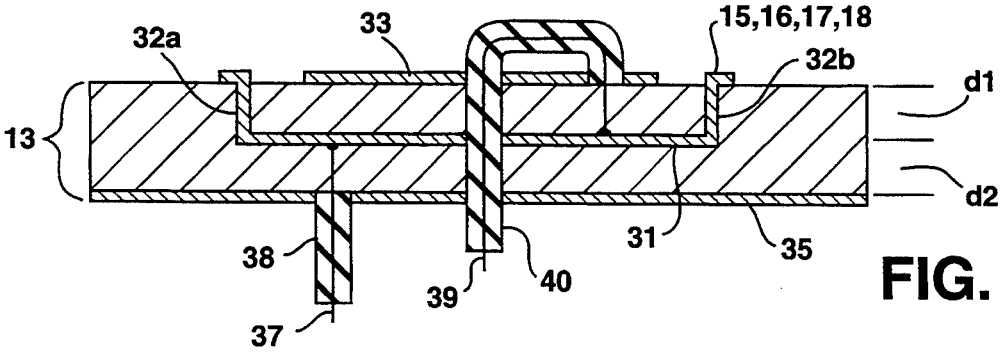
FIG. 2 is a side sectional view of the antenna shown in FIG. 1.

FIGS. 1 and 2 are top and side sectional views of one embodiment 11 of the present invention. A substrate layer 13 of dielectric material of thickness d1+d2 is provided having first and second opposed surfaces. An annular strip consisting of four segments 15, 16, 17 and 18, joined at the corners to form a rectangle of electrically conducting material, is positioned on a first surface of the substrate. The strips 15 and 17 have length d3 and width d5. The strips 16 and 18 have length d4 and width d6, as shown. A rectangle 14 of the substrate 13 is enclosed by the strips 15, 16, 17 and 18. The dielectric substrate has area dimensions d9×d10, as shown. A thin, rectangular layer (patch) 31 of electrically conducting material of area dimensions approximately d7×d8 is positioned in the interior of the substrate 13 at distances d1 and d2, respectively, from the first and second surfaces of the substrate. The layer 31 is electrically connected to one or more of the electrically conducting strips 15, 16, 17 and 18 by conducting layers 32*a* and 32*b*, which can be implemented using through-holes plated with a conductive material.

A first ground plane 33, of rectangular form with dimensions d7×d8, is positioned on the first or front surface of the substrate 13 and is surrounded by and spaced apart from the rectangle formed by the strips 15, 16, 17 and 18. A second ground plane 35 is positioned on the second or back surface of the substrate 13 and may be formed as a rectangle of area dimensions d9×d10. A first signal feed line 37 is electrically connected to the conducting layer 31 at a position 19 on a rectangle diagonal and is electrically isolated from the first and second ground planes 33 and 35 by an insulating cable 38. A second signal feed line 39 is electrically connected to the conducting layer 31 on a second rectangle diagonal at a position 21 and is electrically isolated from the first and second ground planes 33 and 35 by an insulating cable 40. The signal feed line positions 19 and 21 are located at distances d11 and d12, respectively, from the center intersection point of the two rectangle diagonals for the conducting layer 31. More generally, the signal feed point positions 19 and 21 would lie along two diameters of, or be slightly displaced from diameters of, the conducting layer 31. The positions 19 and 21 are chosen to match the local impedance of the conducting layer 31 as closely as possible the 50 Ohm impedances for the two signal feed lines and for suppression of signals with the frequencies $f_2$ and $f_1$ at those respective positions. The first and second feed point positions 19 and 21 might also be chosen to approximately coincide with positions where a component of an oscillating electric field of the second frequency and of the first frequency, respectively, has a node or local minimum in intensity. Second feedline 39 and cable 40 are routed from position 21 on conducting layer 31 up to the first surface of substrate 13. Feedline 39 and cable 40 are then routed towards the second side of the substrate 13 through the center intersection point of the two rectangle diagonals for the conducting layer 31. The line and cable are routed through the center intersection point so as to not affect antenna characteristics of the dual frequency antenna.

First ground plane 33 is used in conjunction with conducting layer 31 and annular strips 15, 16, 17 and 18 to receive one of the desired frequencies. The second ground plane 35 is used in conjunction with the conducting layer 31 to receive the other distinct, desired frequency.

The dimensions of the conducting layer 31 and the distance d11 are chosen to enhance transmission or receipt of signals with the first desired frequency $f_2$. The dimensions of the conducting layer 31 in combination with the strips 15, 16, 17 and 18, plus the distance d12, are chosen to enhance transmission or receipt of signals with the second desired frequency f1. For example, the following choices of dimensions are suitable for the two GPS frequencies f1 =1.575 GHz and f2 =1.277 GHz:

d1=d2=3.12 mm,
d3=6.03 cm,
d4=6.32 cm
d5=0.57 cm,
d6=0.40 cm,
d7=d8=5.09 cm,
d9=d10=10.00 cm,
d11=1.34 cm,
d12=1.59 cm.

The substrate 13 may be one layer or two layers and the dielectric material(s) for the substrate(s) preferably is low loss, with the real part of the relative dielectric coefficient at the frequency of interest satisfying $$\epsilon \approx 2.6 \text{ or } 3.6 \text{ or } 4.2 \text{ or } 9.6 \text{ or } 10.6.$$

Suitable materials for the conducting layer 31 and the ground planes 33 and 35 are Cu, Al, Sn and Ag.

Suitable dielectric materials for the substrate 13 include epoxy, polyimide, polyfluoro-ethylene (such as Teflon) and aluminum ceramic. However, the preferred choice for this dielectric material is polyphenylene oxide resin, a thermosetting resin with a relative dielectric constant $\epsilon_r=3.35$ or 10.5. This dielectric material is discussed by M. Itoh et al in "Thermosetting PPO Laminates For High Frequency Circuits", presented at the Fall Meeting of the Institute for Interconnecting and Packaging Electronic Circuits, Oct. 24–28 1988, Anaheim, California.

Choices of dimensions for the two GLONASS frequencies $f_1=1.602$ GHz and $f_2=1.246$ GHz are similar to those for the GPS frequencies. The Federal Communications Commission has made three frequency ranges available for LANs in the United States: f=0.902–0.928 GHz, f=2.400–2.485 GHz and f=5.725–5.850 GHz. Two frequencies, one drawn from each of two of these three ranges, would often be used for a wireless LAN. These frequency ranges are shared with other over-the-air products, such as security systems and selected consumer products. Different frequency ranges may be provided for wireless LAN communications in another country, but the dual frequency antenna of the invention will operate similarly in any country.

Figure 3:
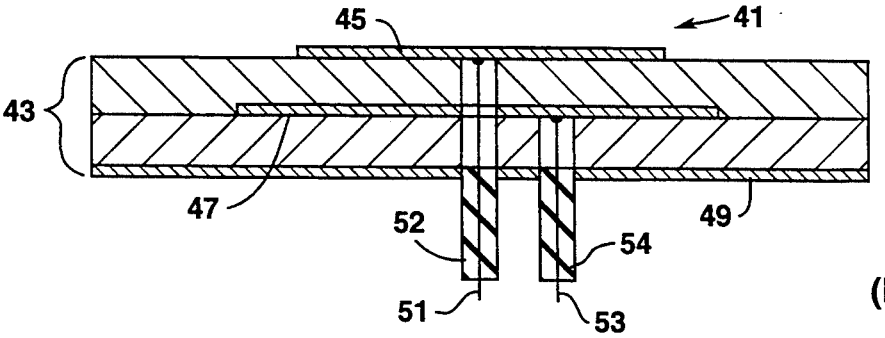
FIG. 3 (PRIOR ART)
FIG. 3 is a side sectional view of a dual frequency antenna from the prior art.

FIG. 3 is a side sectional view of a conventional dual frequency antenna 41. A dielectric substrate 43 with first and second opposing surfaces is provided. A first electrically conducting layer 45 is positioned on the first substrate surface, and a second electrically conducting layer 47 is positioned in the interior of the substrate 43. A ground plane 49 is positioned on the second surface of the substrate 43. First and second signal feed lines 51 and 53 are connected to the first and second conducting layers 45 and 47, respectively, and these feed lines are insulated from other components by insulating cables 52 and 54 as shown. The first and second conducting layers 45 and 47 are electrically isolated from each other, and these two layers are driven independently. FIG. 3 illustrates another, simpler approach for connecting the feed signal lines to the respective feed points on the conducting layers. This simpler approach can also be used to connect the two feed signal lines 37 and 39 (FIG. 2) to the conducting layer 31 in FIG. 1.

Figure 4:
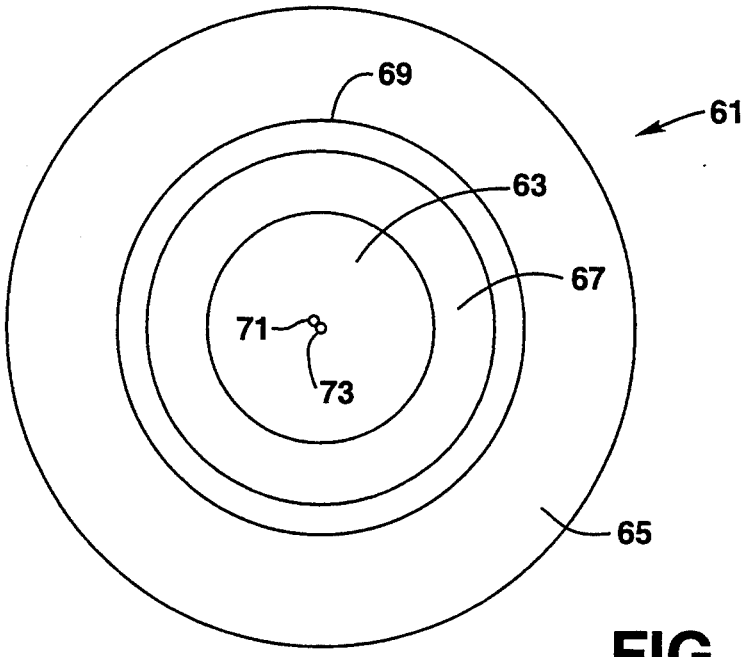
FIGS. 4 and 5 are top sectional views of embodiments of the invention in representative circular and polygonal configurations, respectively.

FIG. 4 is a top sectional view of an embodiment 61 of the invention that uses a circular, or more generally elliptical, annular geometry for receipt and/or transmission of signal at two distinct frequencies. A first circular ground plane 63 is positioned on a first surface of a dielectric substrate 69. A circular strip 69 of electrically conducting material is also positioned on the first substrate surface, surrounding and being spaced apart from the first ground plane 63 by a portion 67 of the substrate material as shown. An electrically conducting layer (patch), coinciding in size with and lying beneath the regions 63 and 67, is positioned in the interior of the substrate 65 and is electrically connected with the circular ring or annulus 69. This electrically conducting layer plus the annular strip 69 provide the desired first and second frequencies at signal feed points 71 and 73, respectively. The dimensions of the components are defined analogously to the dimensions shown in FIGS. 1 and 2.

Figure 5:
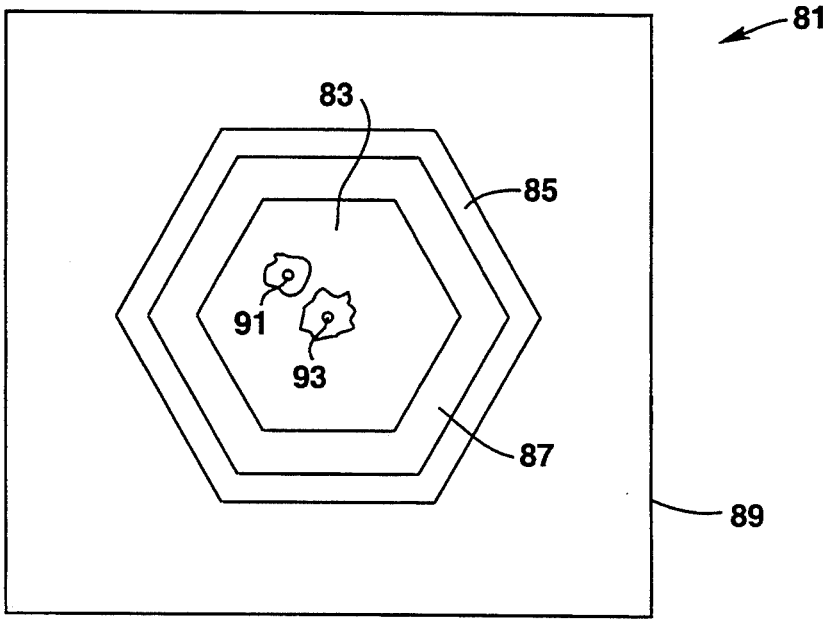

FIG. 5 is a top sectional view of an embodiment 81 of the invention that uses a polygonal annular geometry (hexagonal for illustration) for receipt and/or transmission of signal at two distinct frequencies. A first circular ground plane 83 is positioned on a first surface of a dielectric substrate 89. A polygonal strip 89 of electrically conducting material is also positioned on the first substrate surface, surrounding and being spaced apart from the first ground plane 83 by a portion 87 of the substrate material as shown. An electrically conducting layer (patch), coinciding in size with and lying beneath the regions 83 and 87, is positioned in the interior of the substrate 85 and is electrically connected with the polygonal ring or annulus 89. This electrically conducting layer plus the annular strip 89 provide the desired first and second frequencies at signal feed points 91 and 93, respectively. The dimensions of the components are defined analogously to the dimensions shown in FIGS. 1 and 2. The annular conducting strip used in each of the embodiment illustrated in FIGS. 1, 4 and 5 has approximately constant width, measured in the plane of the first surface of the dielectric material, in a preferred embodiment.

Figure 6:
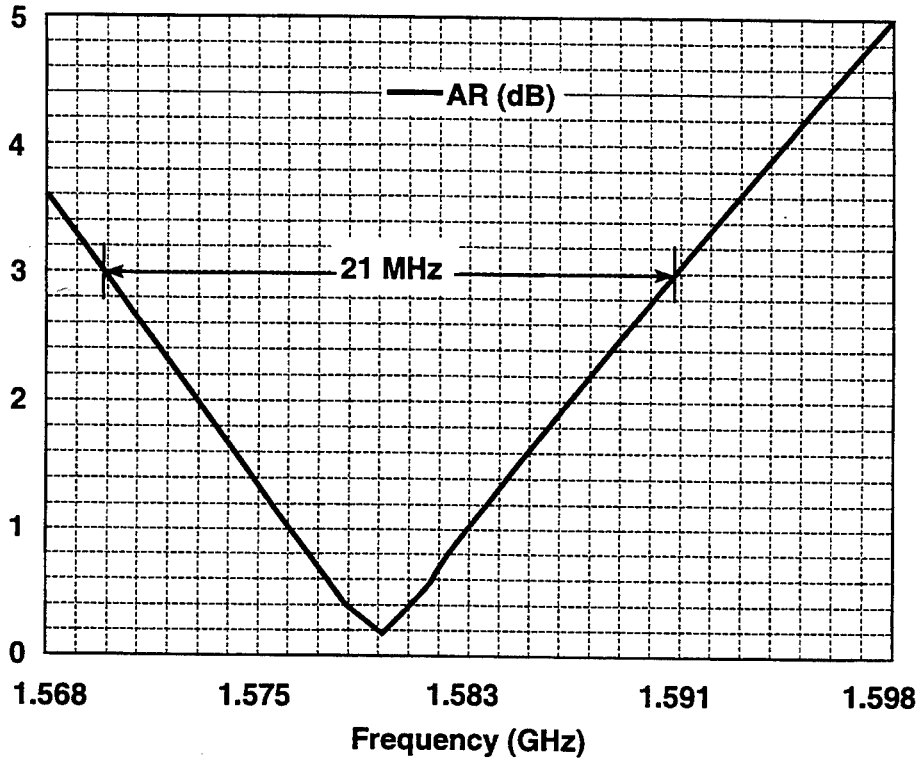
FIGS. 6 and 7 are graphical views illustrating variation of the calculated axial ratio (dB) of the GPS dual frequency antenna, constructed according to the invention, as frequency varies for the two frequencies $f_1=1.575$ GHz and $f_2=1.227$ GHz, respectively.
Figure 7:
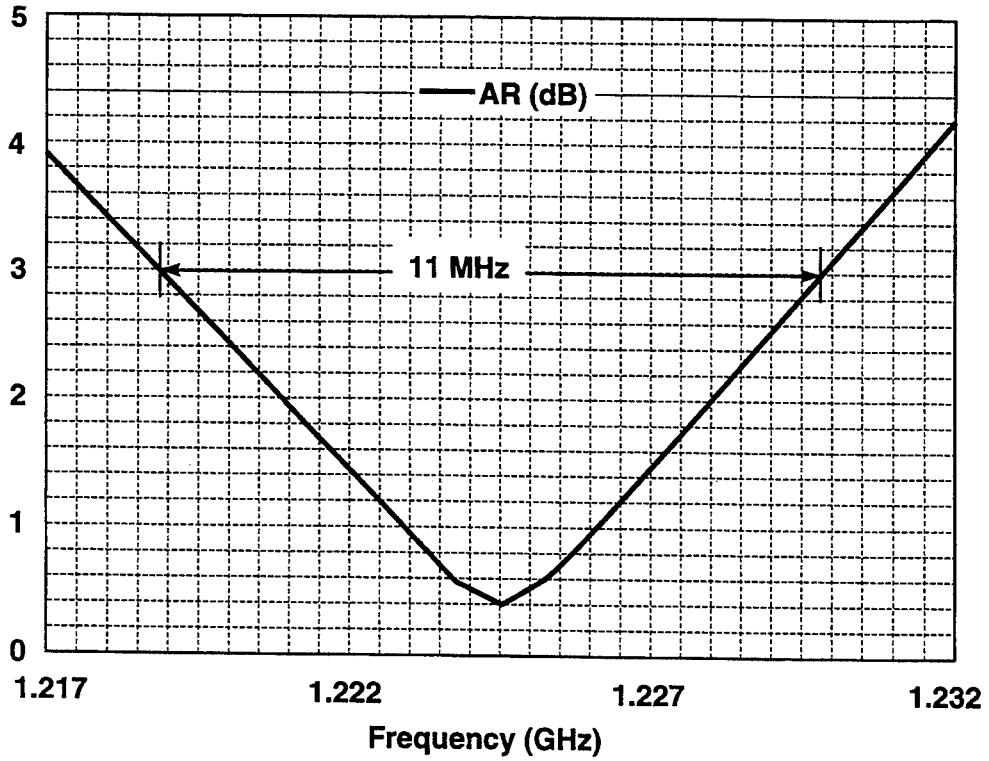

FIGS. 6 and 7 are graphical views of the calculated axial ratio (dB) of the GPS dual frequency antenna, with dimensions d1–d12 chosen as discussed above, as a function of frequency, for frequencies centered at or near $f=f_1=1.575$ GHz and $f=f_2=1.277$ GHz, respectively. The FWHM values for these two center frequencies are 0.021 GHz and 0.011 GHz, respectively. These FWHM values provide adequate tolerance for dual frequency operation.

Figure 8:
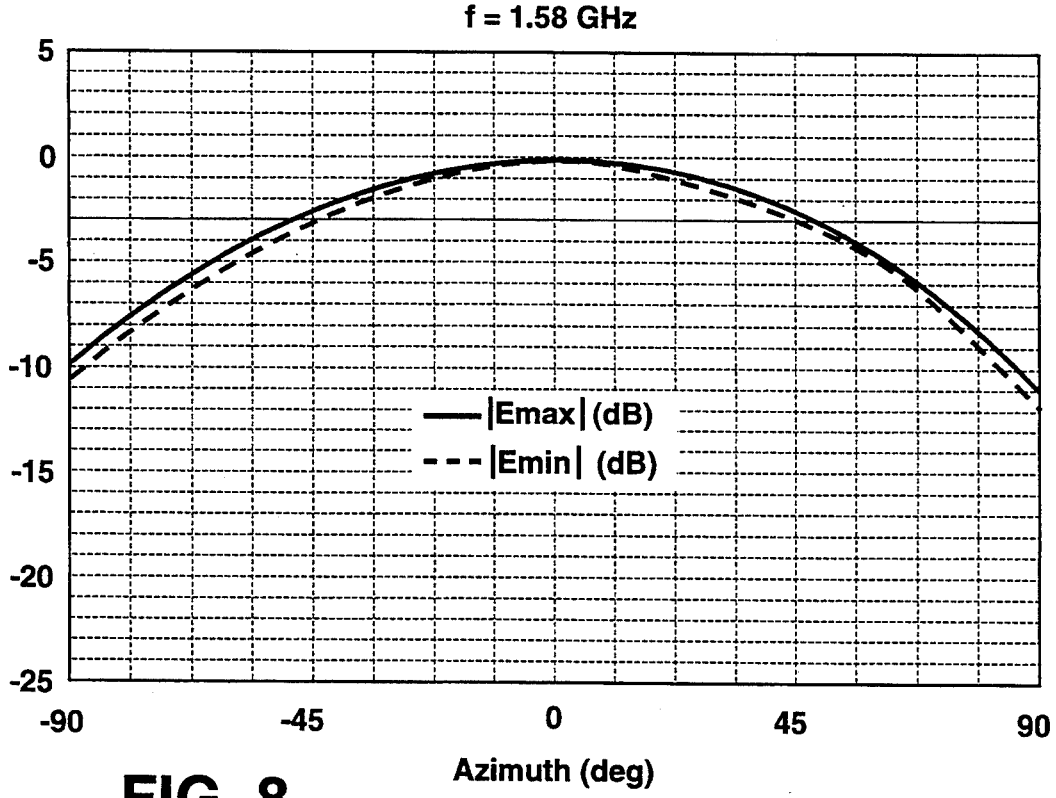
FIGS. 8 and 9 are graphical views illustrating variation of the calculated maximum electric field magnitude (dB) and minimum electrical field magnitude (dB) for the GPS dual frequency antenna, constructed according to the invention, as azimuthal angle for signal receipt varies for the two frequencies $f_1=1.575$ GHz and $f_2=1.227$ GHz, respectively.
Figure 9:
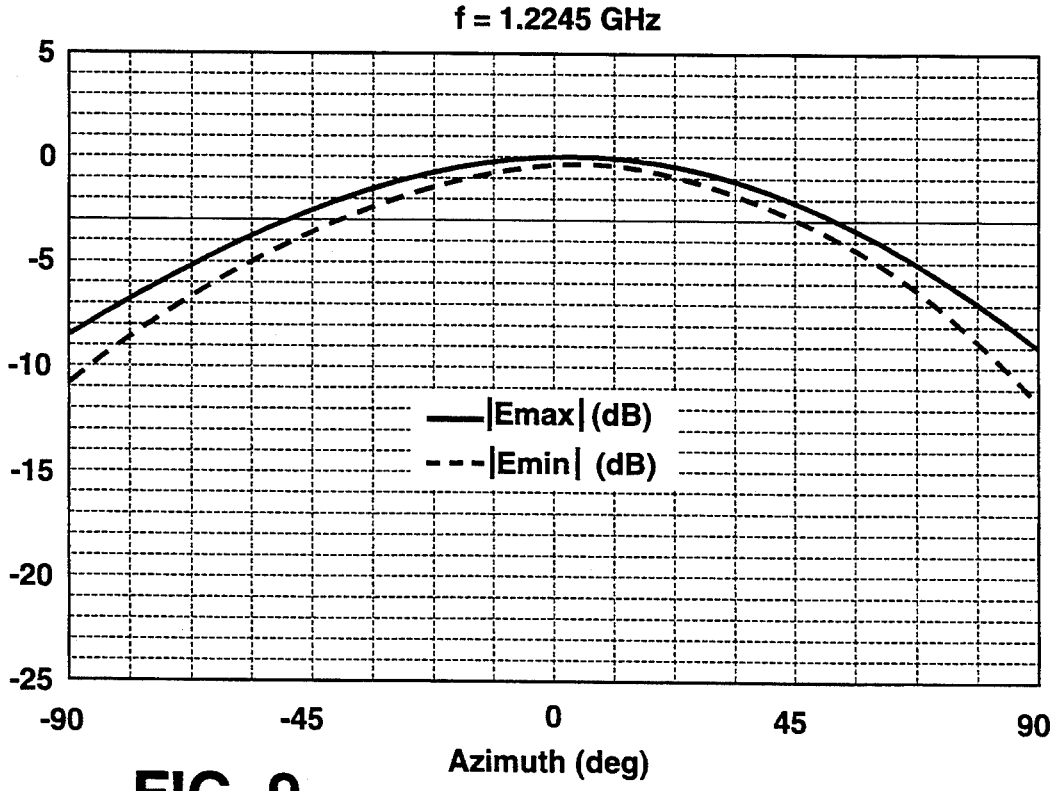

FIGS. 8 and 9 are graphical views of the calculated maximum electrical field magnitude $|E_{max}|$ (dB) and minimum electrical field magnitude $|E_{min}|$ (dB) for the frequencies $f=f_1$ and $f=f_2$, respectively, as a function of azimuthal angle for signal receipt, measured relative to the normal to the antenna plane. Ideally, these maximum and minimum magnitudes would agree for all azimuthal angles. Here, the agreement is adequate for dual frequency signal receipt and transmission.

FIGS. 10 to 13 show a dual frequency antenna apparatus in accordance with another embodiment of the present invention which is similar to the embodiment shown in FIGS. 1 and 2, but differs therefrom particularly with regard to a feeding structure. The antenna apparatus combines two antennas in a single unit, one antenna being a patch antenna for receiving a microwave having a frequency of, for example, $f_2=1.2227$ GHz, and the other antenna being a cavity antenna for receiving a microwave having a frequency of, for example, $f_1=1.575$ GHz.

FIG. 10 is a top plan view of an antenna apparatus 98. FIG. 11 is a side sectional view of antenna apparatus 98 taken along line 11—11 of FIG. 10, and FIG. 12 is a side sectional view taken along line 12—12 of FIG. 10. Antenna apparatus 98 includes a generally rectangular substrate 100 which includes a lower substrate half 101 and an upper substrate half 102. The lower and upper substrate halves 101 and 102 are collectively engaged to form the unitary structure of substrate 100, and are made of suitable dielectric materials such as polyphenylene oxide resin, epoxy, polyimide, polyfluoro-ethylene (such as Teflon) and aluminum ceramic.

A second ground layer 110 is formed on the bottom surface of lower substrate half 101 by well-known printing methods. Second ground layer 110 extends over substantially the entire bottom surface of substrate half 101 except for specific locations, as described below. A patch 120 of generally rectangular configuration is formed by well-known printing methods to the bottom surface of upper substrate half 102. Patch 120 has a smaller surface area than second ground layer 110. Patch 120 is cooperative with the second ground layer 110 to form the patch antenna of this embodiment.

A first ground layer 130 is formed centrally on the top surface of the upper substrate half 102. First ground layer 130 has a generally rectangular configuration and has a smaller surface area than patch 120. Also formed on the top surface of the upper substrate 102 is an annular strip 140 that surrounds the first ground layer 130 within the same plane of the first ground layer. Annular strip 140 is electrically connected to patch 120 by way of a plurality of plated via holes 142 which extend from the inner periphery of annular strip 140 to the outer periphery of patch 120 and which are arranged in a closely spaced relation along the inner periphery of annular strip 140. For the sake of simplicity, plated via holes 142 and other plated holes referred to subsequently are indicated by hatched lines in the figures. Annular strip 140 is cooperative with patch 120 and via holes 142 to define a "cavity", which is then cooperative with first ground layer 130 to form a cavity antenna with a gap 143 defined to extend between first ground layer 130 and annular strip 140.

Annular strip 140 is integrally formed with a tuning stub 141, which extends outwardly from a portion of one side of annular strip 140. First ground layer 130 of the cavity antenna is also integrally formed with tuning stubs 131 and 132, which extend outwardly from portions of two adjacent sides of first ground layer 130 toward annular strip 140 while leaving gap 143 therebetween. Since patch 120 is electrically connected through via holes 142 to annular strip 140, at least a portion of tuning stub 141 can be removed to adjust the frequency of the patch antenna and match the patch antenna to a desired frequency. Likewise, at least a portion of tuning stubs 131 and 132 of first ground layer 130 can be removed to adjust the frequency of the cavity antenna for matching with a desired frequency. Since these tuning stubs 141, 131, and 132 are positioned on the top of substrate 100, an operator may easily adjust the frequency for both the patch antenna and the cavity antenna. It should be noted in this connection that if the patch antenna and the cavity antenna are combined in the abovedescribed manner, no substantial mutual coupling occurs between the two antennas of different modes. Therefore, the frequency adjustment for one of the antennas will not influence the frequency of the other antenna, which assures exact and consistent frequency matching for both of the two antennas.

Figure 13:
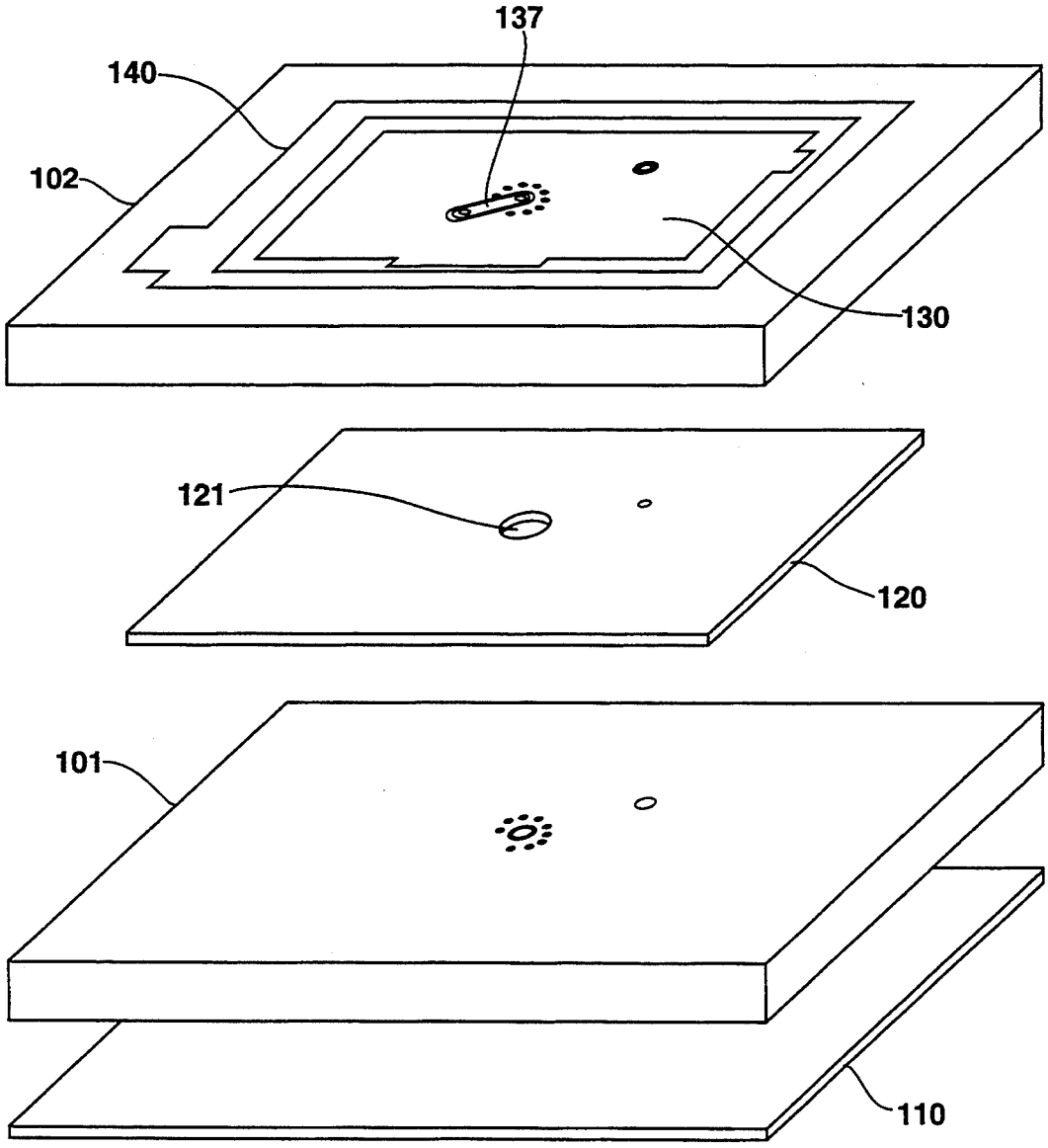
FIG. 13 is an exploded perspective view of the antenna apparatus of FIGS. 10–12.

FIG. 13 is an exploded view of upper substrate half 102, patch 120, lower substrate 101, and second ground layer 110. As shown in the figure, upper substrate 102 includes first ground layer 130, annular strip 140, and coplanar line 137. Patch 120 includes center opening 121, which is described in greater detail with reference to FIG. 14. Lower substrate half 101 is preferably aligned with upper substrate half 102.

Figure 14:
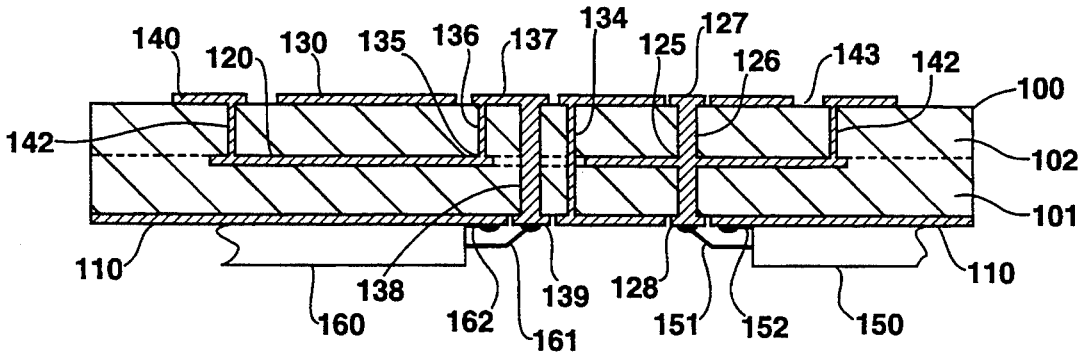
FIG. 14 is a sectional view similar to FIG. 11 showing feedlines for the antenna.

FIG. 14 is a side sectional view of the antenna shown in FIGS. 10, 11 and 12 including cables for reception and transmission. The patch antenna is connected to a corresponding receiver or transmitter (not shown) by way of a semi-rigid cable 150 with a core conductor 151 and a shielding conductor 152. Patch 120 includes a first feedpoint 125, which is offset from the center of patch 120 and is electrically connected to a first internal feedline 126 extending through substrate 100. Feedline 126 is defined by a plated through-hole and has an upper end projecting from the top surface of substrate 100 to define a land 127. The lower end of feedline 126 terminates at a terminal pad 128, which is formed on the bottom surface of substrate 100 in an electrically isolated relation from second ground layer 110. Core conductor 151 of cable 150 is welded to terminal pad 128, while shielding conductor 152 is connected to an adjacent point of second ground layer 110. It is equally possible to weld the core conductor 151 to land 127 instead of terminal pad 128; in this configuration, feedline 126 is best utilized to guide the core conductor from the bottom of substrate 100 to land 127. In this configuration, a pin connector (not shown) with a pin may be utilized instead of cable 150 so that the pin is inserted through feedline 126 for electrical connection to first feedpoint 125 of patch 120.

The cavity antenna is likewise connected to a corresponding receiver or transmitter (not shown) by way of a semi-rigid cable 160 with a core conductor 161 and a shielding conductor 162. Patch 120 has a second feedpoint 135, which is offset from the center of patch 120 and which is electrically connected to a second internal feedline composed of an offset line 136, a joint line 137 on the top surface of substrate 100, and a center line 138. Offset line 136 is defined by a plated via hole extending upwardly from feedpoint 135 to one end of the joint line 137. Joint line 137 is formed as a coplanar line in a coplanar relation to the first ground layer and extends diagonally in relation to and from the center of first ground layer 130 in an electrically isolated relation from first ground layer 130. Center line 138 is defined by a plated through-hole extending vertically through substrate 100 from the other end of joint line 137 and terminating at a terminal pad 139 formed on the bottom surface of substrate 100 in an electrically isolated relation from second ground layer 110. Center line 138 extends through a center opening 121 in the center of patch 120, i.e., a portion which does not affect the antenna characteristics of the patch antenna and the cavity antenna. The cavity antenna includes feedline 136 as part of the cavity antenna structure to receive signals of a particular frequency, and the feedline is further routed through lines 137 and 138 down to the bottom of substrate 100 to connect to cable 160 without causing any undesirable influence on the antenna characteristics.

Core conductor 161 of cable 160 is welded to terminal pad 139 with shielding conductor 162 welded to second ground layer 110. Ground layer 110 is electrically connected to first ground layer 130 of the cavity antenna by way of a plurality of plated through-holes 134 extending from the second ground layer 110 to the first ground layer 130. Through-holes 134 also extend through center opening 121 of patch 120 in a radially spaced relation to center line 138. That is, through-holes 134 are arranged in closely spaced relation to each other along an arcuate path which is centered on center line 138 and extends over an angle of about 250° . Core conductor 161 may be alternately inserted through center line 138 and welded to joint line 137. Further, a pin connector with a pin may be utilized instead of cable 160 so as to insert the pin in the center line 138 for electrical connection to second feedpoint 135 of patch 120.

It should be noted that first and second feedpoints 125 and 135 are defined in a coplanar relation on patch 120 so that the two antennas can, for example, provide consistent position data from information sent by two signals having different frequencies for exact and reliable position measurement. In this embodiment, first and second feedpoints 125 and 135 are designed to be arranged commonly on one of the diagonals of rectangular patch 120 passing through center line 138 for easy manufacturing of the antenna apparatus and to facilitate drilling center line 138, offset line 136, and feedline 126 in substrate 100.

Figure 15:
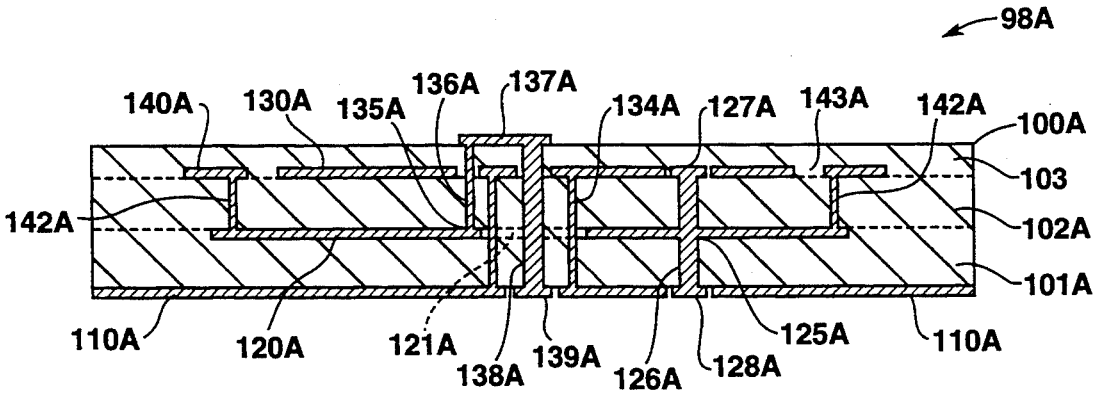
FIG. 15 is a sectional view illustrating a modification of the antenna apparatus of FIGS. 10–12.

FIG. 15 is a side sectional view of an alternate embodiment of the antenna apparatus shown in FIGS. 10–14. In the apparatus 98A of FIG. 15, an additional substrate 103 of like dielectrical material is positioned on top of substrate 100A to carry a microstrip line 137A of an electrically conducting material which constitutes a part of the second feedline to second feedpoint 135A to interconnect center line 138A and offset line 136A rather than being directly formed on substrate 100A. Similar elements are designated by the same numerals with a suffix letter of "A". Accordingly, no duplicate explanation is made herein for the sake of simplicity.

Although the above embodiments of FIGS. 10–15 utilize plated through-holes or via holes for electrical interconnection between the conductors on the top, bottom, and interior of the substrate, it is equally possible to use leads, pins or similar elements for the same electrical interconnection. Further, patch 120 and 120A, first and second ground layers 130, 130A and 110, 110A, and annular strip 140, 140A can have circular, elliptic, or polygonal configurations in altemate embodiments.

While this invention has been described in terms of several preferred embodiments, it is contemplated that alterations, modifications and permutations thereof will become apparent to those skilled in the art upon a reading of the specification and study of the drawings. It is intended that the following appended claims include all alterations, modifications and permutations that fall within the spirit and scope of the present invention.

What is claimed is:

1. An apparatus for receiving microwave signals having first and second distinct frequencies, the apparatus comprising:

a substrate of dielectric material having a selected substrate thickness and having opposed first and second surfaces;

a first grounded layer of electrically conducting material, positioned on the first surface of the substrate;

a first conducting layer of electrically conducting material, positioned on the first surface of the substrate and formed as an annular strip that surrounds and is spaced apart from the first grounded layer;

a second conducting layer of electrically conducting material, positioned in the interior of the substrate, facing and spaced apart from the first grounded layer, and electrically connected to the first conducting layer, said second conducting layer forming a closed, substantially planar geometrical figure having solid, contiguous material between sides of said figure; and a second grounded layer of electrically conducting material, positioned on the second surface of the substrate so that the second conducting layer is positioned between and spaced apart from the first grounded layer and the second grounded layer.

2. The apparatus of claim 1, further comprising:

a first signal receiver, electrically connected to said second conducting layer, for receiving a microwave signal having said first frequency; and a second signal receiver, electrically connected to said second conducting layer, for receiving a microwave signal having said second frequency.

3. The apparatus of claim 2, wherein said first and second signal receivers are connected to said second conducting layer at selected first and second positions, respectively, on said second conducting layer, wherein said first and second positions on said second conducting layer are chosen to enhance the reception and transmission of said signals having said first frequency and said second frequency, respectively.

4. The apparatus of claim 3, wherein said second conducting layer forms a substantially rectangular geometrical figure.

5. The apparatus of claim 1, wherein said second layer of electrically conducting material has a shape that is selected from the group consisting of a rectangle, an ellipse and a polygon.

6. The apparatus of claim 5, wherein said first conducting layer has an inner perimeter and an outer perimeter, and the inner perimeter has a shape that is selected from the group consisting of a rectangle, an ellipse and a polygon.

7. The apparatus of claim 1, wherein said first grounded layer forms said figure having approximately the same shape as a shape formed by said second conducting layer.

8. The apparatus of claim 1, wherein said dielectric material for said substrate is drawn from the group consisting of epoxy, polyimide, poly-fluoro-ethylene, alumina ceramic and polyphenylene oxide resin.

9. The apparatus of claim 1, wherein said first frequency and said second frequency are drawn from the frequency pairs consisting of 1.227 GHz, 1.575 GHz and 1.246 GHz, 1.602 GHz.

10. The apparatus of claim 1, wherein said first frequency is chosen to lie in one of the frequency ranges f=0.902–0.928 GHz, f=2.400–2.485 GHz and f=5.725–5.850 GHz, and said second frequency is chosen to lie in one of these three frequency ranges in which said first frequency does not lie.

11. The apparatus of claim 1, wherein said first and second frequencies are chosen to be approximately 1.575 GHz and 1.227 GHz, respectively, and said apparatus has an axial ratio, for frequencies adjacent to said first frequency, of no more than about 0.021 GHz.

12. The apparatus of claim 1, wherein said first and second frequencies are chosen to be approximately 1.575 GHz and 1.227 GHz, respectively, and said apparatus has an axial ratio, for frequencies adjacent to said second frequency, of no more than about 0.011 GHz.

13. The apparatus of claim 3, wherein said first position and second position are located on first and second diagonals, respectively, of said second conducting layer.

14. Apparatus for receiving and/or transmitting microwave signals having first and second distinct frequencies, the apparatus comprising:

a substrate of dielectric material having opposed first and second surfaces;

a first ground layer of electrically conducting material positioned on said first surface of the substrate;

a second ground layer of electrically conducting material positioned on said second surface of the substrate;

a patch of electrically conducting material, said patch being a solid plate which is positioned within said substrate and which is spaced from said second ground layer in substantially parallel relation thereto, said patch cooperative with said second ground layer to define a patch antenna for receiving and transmitting a microwave signal having said first frequency; and an annular strip of electrically conducting material, positioned on said first surface of the substrate and surrounding said first ground layer in spaced relation thereto, said annular strip being electrically coupled to said patch by way of an extension extending from said patch to said annular strip in spaced relation from an outer perimeter of said first ground layer;

said first ground layer being cooperative with said patch, said extension, and said annular strip to define a cavity antenna for receiving and transmitting a microwave signal having said second frequency.

15. The apparatus of claim 14, wherein said first ground layer and said second ground layer are electrically connected by way of a ground line extending through the substrate.

16. The apparatus of claim 15, wherein said ground line is defined by a plurality of plated through-holes extending through said substrate.

17. The apparatus of claim 14, wherein said patch is connected to a first internal feedline for said patch antenna, said first feedline extending from a first feed point on said patch through a portion of the substrate to a first terminal which is formed on the second surface in an insulating relation from said second ground layer, and wherein said patch is connected to a second internal feedline for said cavity antenna, said second internal feedline extending from a second feed point on said patch and extending through the substrate to a second terminal which is formed on said second surface of the substrate in an insulating relation from said second ground layer, said patch having a center opening positioned at the center of the patch;

said first feed point and said first internal feedline being offset from said center opening;

said second feed point being offset from said center opening;

said second internal feedline including an offset line extending through a portion of said substrate in an offset relation from said center opening, a center line extending through said center opening, and a joint line connecting said offset line and said center line.

18. The apparatus of claim 17, wherein at least one of said first internal feedline, said offset feedline, and said center line is defined by a plated via hole extending through the substrate.

19. The apparatus of claim 17, wherein said joint line is formed on said first surface of the substrate as a coplanar line in a coplanar relation to said first ground layer, said coplanar line extending within the confine of said first ground layer in spaced relation thereto.

20. The apparatus of claim 17, wherein said joint line is formed as a microstrip line on an auxiliary substrate superimposed on said first surface of said substrate over said first ground layer.

21. The apparatus of claim 14, wherein said extension is defined by a plurality of plated via holes extending from an inner circumference of said annular strip and terminating at an outer circumference of said patch.

22. The apparatus of claim 14, wherein said annular strip is integrally formed with at least one patch tuning stub exposed on said first surface of the substrate, said patch tuning stub being adapted in use to be at least partially detached for frequency matching of said patch antenna.

23. The apparatus of claim 14, wherein said first ground layer is integrally formed with at least one cavity tuning stub exposed on said first surface of the substrate and projecting toward said annular strip, said second tuning stub being adapted in use to be at least partially detached for frequency matching of said cavity antenna.

24. The apparatus of claim 17, wherein said first and second feedpoints are formed on said patch within the same plane.

25. The apparatus of claim 17, wherein said patch is of substantially rectangular configuration and said first and second feedpoints are arranged commonly along one diagonal of said patch.

26. The apparatus of claim 14, further comprising:

a first signal receiver, electrically connected to said patch antenna, for receiving a microwave signal having said first frequency; and a second signal receiver, electrically connected to said cavity antenna, for receiving a microwave signal having said second frequency.

27. The apparatus of claim 26, wherein said first and second signal receivers are connected to said patch at selected first and second positions, respectively, on said patch, wherein said first and second positions on said patch are chosen to enhance the reception and transmission of said signals having said first frequency and said second frequency, respectively.

28. The apparatus of claim 27, wherein said patch forms a substantially rectangular geometrical figure.

29. The apparatus of claim 14, wherein said patch has a shape that is selected from the group consisting of a rectangle, an ellipse, and a polygon.

30. The apparatus of claim 29, wherein said annular strip has an inner perimeter and an outer perimeter, and the inner perimeter has a shape that is selected from the group consisting of a rectangle, an ellipse, and a polygon.

31. The apparatus of claim 14 wherein said first grounded layer has a shape approximately the same as a shape formed by said patch.

32. The apparatus of claim 14, wherein said dielectric material for said substrate is drawn from the group consisting of epoxy, polyimide, poly-fluoroethylene, alumina ceramic and polyphenylene oxide resin.

* * * * *